United States Patent [19]

Matthews

[11] 4,230,444

[45] Oct. 28, 1980

[54] METHOD AND APPARATUS FOR FUEL IGNITION SYSTEM INCLUDING COMPLETE CYCLING OF FLAME RELAY PRIOR TO TRIAL FOR IGNITION

[75] Inventor: Russell B. Matthews, Goshen, Ind.

[73] Assignee: Johnson Controls, Inc., Milwaukee, Wis.

[21] Appl. No.: 897,761

[22] Filed: Apr. 17, 1978

[51] Int. Cl.[3] ..... F23Q 9/08

[52] U.S. Cl. ..... 431/6; 431/26; 431/45; 431/46; 431/71

[58] Field of Search ..... 431/24–26, 431/45, 46, 70, 71, 6

[56] References Cited

U.S. PATENT DOCUMENTS

| | | | |
|---|---|---|---|
| 2,313,943 | 3/1943 | Jones | 431/25 |
| 3,482,922 | 12/1969 | Blackett | 431/26 |
| 3,816,053 | 6/1974 | Cade | 431/46 |
| 4,035,134 | 7/1977 | Matthews | 431/21 |
| 4,047,878 | 9/1977 | Matthews | 431/22 |
| 4,078,897 | 3/1978 | Dietz | 431/26 |

*Primary Examiner*—Carroll B. Dority, Jr.
*Attorney, Agent, or Firm*—Emrich, Root, Lee, Brown & Hill

[57] ABSTRACT

When a call for heat is established, a flame relay is actuated for a predetermined time by means of a cycling timer. Upon this initial actuation, the flame relay inhibits a checking relay and initializes a trial-for-ignition (or simply "ignition") timer. After the cycling timer times out and the flame relay has been completely cycled, which established operativeness of the flame relay and flame sensing circuitry, the checking relay is enabled and actuated for the ignition period. The checking relay then actuates the pilot valve and a spark generator to start a pilot flame. If a flame is sensed, before the ignition timer times out, the flame relay actuates the main valve and establishes a holding current for the ignition timer so that the checking relay continues to be energized. If a flame is not sensed during the trial period, the ignition timer disables the checking relay, thereby de-energizing the pilot valve before the main valve is opened. If there is a fault in the flame relay or flame sensing circuitry, the checking relay is inhibited from operating. Both timers are preferably electronic timing circuits using capacitors in such a manner that circuit faults do not cause system malfunction. In an alternative embodiment, separate flame sensing circuits control the operation of the flame relay and the ignition timer.

23 Claims, 5 Drawing Figures

METHOD AND APPARATUS FOR FUEL IGNITION SYSTEM INCLUDING COMPLETE CYCLING OF FLAME RELAY PRIOR TO TRIAL FOR IGNITION

BACKGROUND OF THE INVENTION

1. Field of the Invention

This invention relates to fuel ignition systems of the intermittent pilot type, and more particularly, to control arrangements for use in such systems which provide fail-safe operation of the fuel valves of the systems.

2. Description of the Prior Art

In intermittent pilot type fuel ignition systems, a pilot valve is operated at the start of an operating cycle to supply fuel to a pilot outlet for ignition to provide a pilot flame. A pilot flame sensor, which typically includes an electronic flame sensing circuit, detects the pilot flame and only then effects energization of the main valve, generally by operating a "flame relay", to supply fuel to a main burner which is ignited by the pilot flame.

In order to prevent unintended actuation of the main valve under fault conditions of the flame sensing circuitry or for a welded contact failure of the flame relay, relay checking arrangements have been incorporated into intermittent pilot ignition systems to test the integrity of the flame sensing circuit and the flame relay before the main valve is operated. In such arrangements, a control or "checking" relay is energized at the start of an operating cycle over a circuit path which includes normally closed contacts of the flame relay. The checking relay operates to close normally open contacts which are connected in the energizing path for the main valve, permitting the main valve to be energized when the flame relay operates. If for any reason the flame relay is operated at the start of an operating cycle so that its normally closed contacts are open, then the checking relay cannot operate thereby preventing energization of the main valve.

In some relay checking arrangements, the pilot valve is also energized under the control of the checking relay. Such arrangements permit both pilot and main valves to be maintained deenergized for a fault which prevents normal system operation.

A further improvement in control arrangements has been the addition of a timing device to time the interval for which the pilot valve is operated at the start of a heating cycle. One such system, disclosed in my U.S. Patent application Ser. No. 790,408 filed on Apr. 25, 1977, and now U.S. Pat. NO. 4,178,149, employs a mechanical warp switch timer which enables the pilot valve to be energized only for a pretimed duration at the start of an operating cycle. The warp switch timer defines the trial for ignition interval and deenergizes the pilot valve at the end of such interval unless a pilot flame is established. Under normal operating conditions, a pilot flame is established before the warp switch times out, and the flame relay operates to override the warp switch timer, permitting the pilot valve to remain energized. For a flameout following a successful ignition cycle, the timer is reenabled under the control of the flame relay to define a further timing interval and to effect deenergization of the pilot valve if a flame is not provided before the timer times out.

In this arrangement, the warp switch timer limits the time for which the pilot valve can remain energized in the absence of a flame. However, the operation of the warp switch timer to provide its timeout signal is predicated on the ability of the flame sensing circuit and flame relay to indicate loss of flame. Also, in known arrangements which employ mechanical warp switch timers to define the trial for ignition interval, certain fault conditions of the warp switch timer may result in lengthening the trial for ignition interval, an undesireable condition.

SUMMARY OF THE INVENTION

The present invention includes a flame relay and associated flame sensing circuitry which is adapted to sense and establish the presence of a pilot flame for actuating the flame relay continuously when a pilot flame is established.

In order to commence operation of the system, when there is a call for heat, a first timer (called a "cycling" timer) is energized by the closing of the thermostat contacts for actuating the flame relay independently of the flame sensing circuitry for a short, predetermined time, in the order of two seconds. When this occurs, a second timer, called the "ignition" timer is energized (also through the thermostat contacts) for establishing a trial-for-ignition period. The ignition timer is preferably an electronic timer including a timing capacitor which determines the trial-for-ignition interval. An electronic timer is preferred because in the event of a short in the timing capacitor, the trial-for-ignition period is shortened or reduced to zero.

The ignition timer is used to actuate a checking relay for the trial-for-ignition interval. The checking relay, in turn, energizes a pilot valve solenoid and a spark generator. If, as is the normal case, the pilot fuel is ignited within the trial-for-ignition interval, the flame sensing circuitry re-actuates the flame relay which, because the checking relay is now actuated, causes the main valve solenoid to be energized.

If, for reason of fault either in the flame relay or the flame sensing circuitry associated therewith, and there is a call for heat during such fault, the ignition timer may be energized, but the checking relay cannot be energized because of interlocking contacts associated with the flame relay. The pilot and main valves are connected in a redundant configuration wherein fuel is supplied to the main valve through the pilot valve, affording 100% shut off of fuel supply to the burner when the pilot valve solenoid is deenergized.

If, during normal operation, there is a flameout, the flame sensing circuitry deenergizes the flame relay to open the main valve and, at the same time, to re-initialize the ignition timer and commence a new trial-for-ignition interval.

If the flame relay fails to operate at the start of an operating cycle, the timing capacitor of the ignition timer cannot charge to its initial value and the checking relay is maintained deenergized. If the flame relay is operated at the start of an operating cycle, due to a fault condition, the energizing path for the checking relay is interrupted and the checking relay prevents operation of both the pilot and main valves.

In a further embodiment, separate flame sensing circuitry controls the operation of the flame relay and the ignition timer respectively. In this arrangement, the trial-for-ignition interval is determined by the charging time of a timing capacitor. While the timing capacitor charges at the start of an operating cycle, the ignition timer provides a timing signal for enabling the checking relay to energize the pilot valve and spark generator. If a flame is provided before the capacitor is fully charged, the flame relay is operated by its associated flame sensing circuitry which prevents the timing capacitor from becoming fully charged. If a flame is not sensed before the capacitor is fully charged, the ignition timer disables the checking relay, deenergizing the pilot valve.

In the event of flameout following a successful ignition cycle, the flame relay is deenergized by its associated flame sensing circuitry to deenergize the main valve, and the control of the operation of the checking relay is returned to the ignition timer which disables the checking relay if the flame is not reestablished within the predetermined ignition time.

In this arrangement, the deenergization of the checking relay, and thus the pilot valve under flame out conditions, is controlled independently of the flame sensing circuitry associated with the flame relay. Again, the pilot and main valve are connected in a redundant valve configuration so that a flame out followed by unsuccessful reignition within the time interval defined by the ignition timer results in 100% shut off of fuel even though there may be a fault in the flame sensing circuitry associated with the flame relay.

The spark generator may also include a flameresponsive enabling circuit which permits operation of the spark generator conditioned on the presence of a flame. Thus, any fault in the flame sensing circuitry will not affect operation of the spark generator and its relation with the flame. That is, if a fault occurs in the flame sensing circuitry following a successful ignition cycle, and a flame out occurs, the spark generator is enabled by its associated enabling means to provide sparks for reliting the pilot.

In accordance with a feature of the invention the flame sensing circuitry is energized continuously and the checking relay circuitry and ignition timer are energized in response to the closing of thermostatically controlled contacts. Accordingly, a fault in the flame sensing circuitry will cause the flame relay to operate to interrupt the energizing path for the checking relay preventing start up of the system.

A reset circuit associated with the ignition timer responds to interruption of power to effect rapid discharge of the timing capacitor in the ignition timer so that the capacitor is discharged when power is restored. This prevents the checking relay from operating before the flame relay under a fault condition for the flame sensing circuitry.

In accordance with a further feature of the invention, a normally conducting silicon controlled rectifier, connected in the energizing path for the checking relay, is enabled by a timing signal provided by the timer to permit energization of the checking relay. A control network couples the silicon controlled rectifier to the flame relay and allows the flame relay to operate for a failure of the silicon controlled rectifier which permits it to conduct as a diode in the absence of the timing signal. The checking relay inhibits the control network when it is operated.

DESCRIPTION OF PREFERRED EMBODIMENTS

General Description

Figure 1:
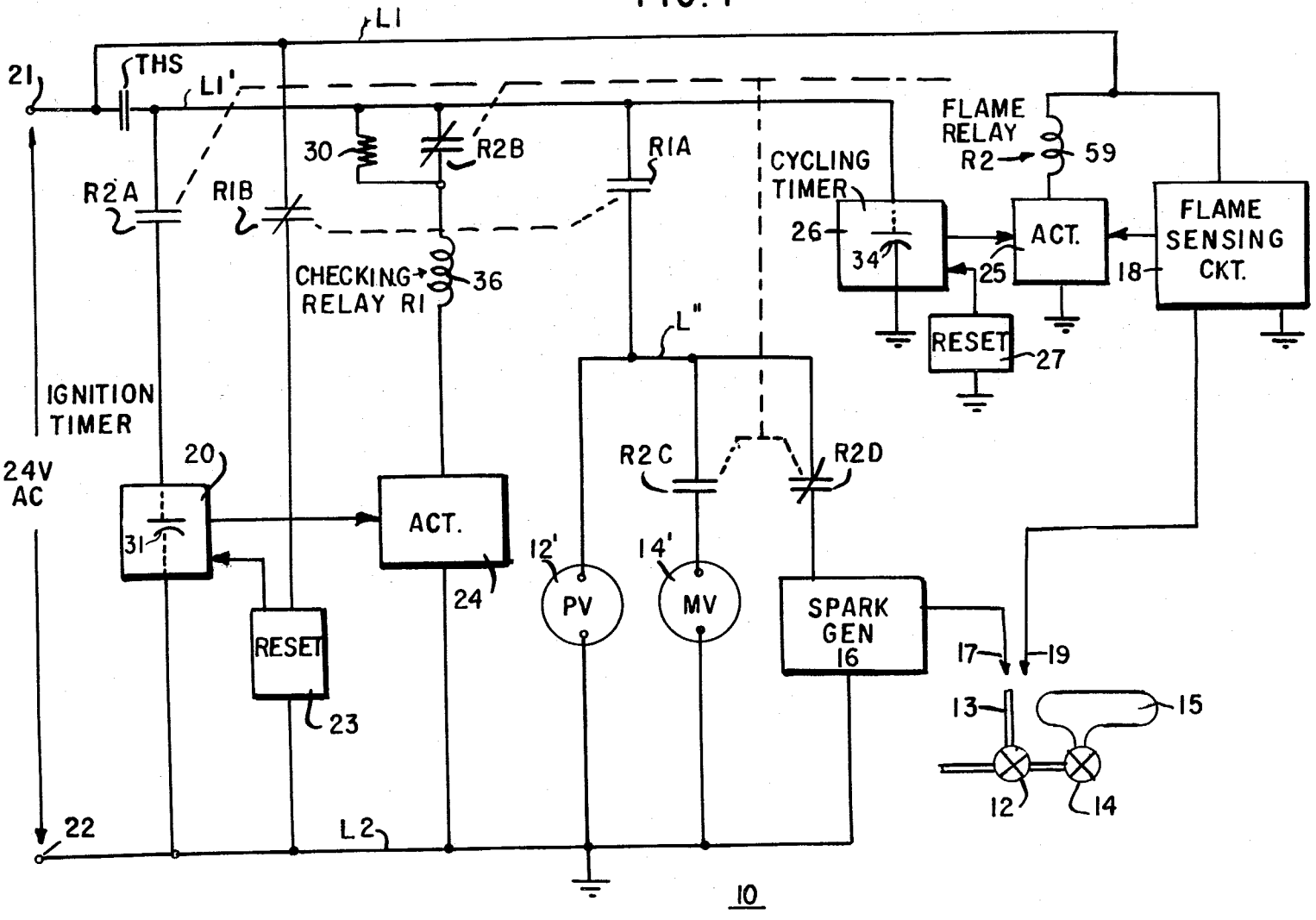
FIG. 1 is a block diagram partially in schematic circuit form of a fuel ignition control system provided by the present invention, and which is described with reference to an application in a heating system.

Referring to the drawings, FIG. 1 is a block diagram, partially in circuit schematic form of a fuel ignition control system 10 provided by the present invention. The control system is described with reference to an application in a heating system including a pilot valve solenoid 12, a main valve solenoid 14, a spark generating circuit 16, and flame sensing circuitry 18. The fuel valves are connected in a redundant configuration by which fuel supplied to the main valve flows through the pilot valve as is known in the art.

Power is supplied to the control arrangement via input terminals 21 and 22 to which are connected to conductors L1 and L2, respectively, for energizing the flame sensing circuitry 18. The fuel valves and the spark generating circuit are energized by power extended to conductors L1' and L2 when thermostatically controlled contacts THS are closed. Conductor L2 is connected to system ground.

A flame relay R2 includes a coil 59 connected between terminal 21 and an actuating circuit 25 to be described. The flame relay has normally open contacts R2A and R2C, and normally closed contacts R2B and R2D. A first timer circuit 26 is connected between the contacts THS and ground. The function of timer 26 is to energize the actuating circuit 25 for a predetermined initial period in the order of two seconds to completely cycle the flame relay R2 and its contacts prior to establishing a trial-for-ignition interval. To facilitate understanding of the circuitry, the timer 26 is referred to as a cycling timer (short for "flame relay cycling timer"), and it may include a timing capacitor shown at 34.

A second timer circuit 20 is connected in circuit with contacts R2A, and in a preferred electronic embodiment, it includes a timing capacitor 31. The function of the timer 20 is to establish a trial-for-ignition period, and for short, it is referred to as a "ignition" timer. When it is initialized and energized, the ignition timer 20 causes an actuating circuit 24 to energize a coil 36 of a checking relay R1 which is connected in circuit with normally closed contacts R2B. Thus, relay R1 can be energized only if relay R2 is deenergized and its contacts R2B are closed. For a fault of the flame sensing circuitry 18 which permits relay R2 to be operated in the absence of a flame, contacts R2B of relay R2 are open and prevent relay R1 from operating. Also, if contacts R2A become welded together, then contacts R2B, which employ a common armature of the relay are maintained open, preventing energization of relay R1. For such conditions, the pilot valve 12 is maintained deenergized when contacts THS close. A resistor 30 is connected across the contacts R2B. The value of resistor 30 is selected to provide sufficient current to hold the checking relay R1 energized, once it has been energized, but to prevent operation of the relay if it is not already energized.

The checking relay has normally closed contacts R1B which are connected in circuit between the line L1 and a reset circuit 23 (used to reset the ignition timer 20), and normally open contacts R1A. The contacts R1A are connected in circuit with a pilot valve solenoid, the coil of which is shown at 12', a main valve solenoid, the coil of which is designated 14', and the spark generating circuit 16. Previously described contacts R2C are connected between the contacts R1A and the main valve solenoid 14', and contacts R2D are connected between the contacts R1A and the spark generator 16.

The spark generating circuit 16 has a spark electrode 17 spaced from a pilot outlet 13 which may be grounded to the supply conduits. Fuel is supplied from a source (not shown) through the pilot valve 12 which is actuated by its solenoid 12'. The pilot valve is connected in series with a main valve 14 which is actuated by its solenoid 14' to supply fuel to a main burner 15. A flame sensor electrode 19 is conventionally placed in proximity to the pilot 13 and coupled to the flame sensing circuitry 18.

In operation, when the contacts THS close, if everything is operating properly, the cycling timer 26 is energized to charge capacitor 34 and immediately enable the flame relay R2 via the actuation circuit 25. This causes contacts R2B to open to prevent the checking relay from operating. It also causes contacts R2A to close to charge capacitor 31 of the ignition timer 20. After a predetermined time, in the order of two seconds, the capacitor 34 of the cycling timer becomes fully charged and causes the flame relay R2 to drop out.

Contacts R2B re-close to permit the checking relay R1 to be energized by means of the actuating circuit 24. Contacts R2A open, thereby causing capacitor 31 to commence discharge and initiate the trial-for-ignition interval, which is in the order of twenty seconds. The checking relay R1 operates to close contacts R1A to energize the pilot valve solenoid 12' and the spark generating circuit 16 (via then closed contacts R2D).

If, as in a normal case, a flame is sensed by the flame sensing circuitry 18 prior to the time the ignition timer 31 times out, the flame sensing circuitry 18 reenables the flame relay R2 to close contacts R2C, thereby actuating the main valve 14 by means of the solenoid 14'. Further, contacts R2A are closed to supply a holding current to capacitor 31 of the ignition timer, thereby maintaining the checking relay R1 in the operated state. Fuel is supplied until the thermostat contacts THS open which causes the checking relay R1 to drop out, the deactuating the pilot and main valves to extinguish the flame. The flame sensing circuitry 18 thereupon deactuates the flame relay R2. Reset networks 23 and 27 discharge timing capacitors 31 and 34, respectively when contacts THS open to prepare the timer circuits for the next operating cycle.

If, while the thermostat contacts THS remain made, a flameout occurs, the flame sensing circuitry 18 deenergizes the flame relay R2 to open the main valve and also to open contacts R2A, thereby re-commencing a trial-for-ignition interval.

If, during the initial operating cycle, no flame is detected by the sensing circuitry 18 prior to the time the ignition timer 20 times out, the checking relay is disabled, thereby deenergizing the pilot valve and spark generating circuit 16. The system is then locked out until the thermostat contacts open, which is required in order for the capacitor 34 of the cycling timer 26 to be discharged. If this capacitor is not discharged, the flame relay cannot be re-actuated.

It will thus be observed that the flame relay R2 undergoes a complete cycle of operation, that is, from its deenergized state it is energized and then deenergized by means of the cycling timer 26, before the main valve solenoid is energized. If the flame relay fails to operate, or fails to drop out when timer 26 times out, then relay R1 cannot be energized and the system is locked out. If the flame relay R2 is already energized, (for example as the result of a fault in the sensing circuitry 18) or if contacts R2A are welded closed, then contacts R2B remain open to prevent energizing of the checking relay R1. In the event of these faults, when the thermostat contacts THS close, capacitor 31 charges and remains charged until the thermostat contacts open. The actuating circuit 24 is enabled, but the relay R1 is not energized because contacts R2B are open due to the fault.

The flame sensing circuitry 18 is energized over conductors L1 and L2 continuously and independently of the contacts THS. This permits relay R2 to be energized under fault conditions of the flame sensing circuitry 18, and to thereby interrupt the energizing path for relay R1. Moreover, for a fault condition of the timing network 26, such as a shorted capacitor 34, which permits relay R2 to operate when contacts THS close and remain operated until contacts THS reopen, contacts R2B will open and remain open. Thus, although capacitor 31 is charged, contacts R2B prevent energization of relay R1 so that the system is locked out with both fuel valves deenergized. Under such condition, relay R1 is maintained deenergized, even if contacts THS are quickly recycled open and closed. That is, when contacts THS are opened, removing power from conductor L1', actuating circuit 25 causes relay R2 to deenergize so that contacts R2B reclose. However, the reset network 23 is enabled over contacts R1B and causes capacitor 31 of timing network 20 to begin to discharge and when contacts THS reclose, the capacitor 31 is discharged and cannot charge until relay R2 again operates. Thus, the actuating circuit 24 remains disabled and relay R1 is not energized. Reset network 23 is inhibited whenever relay R1 is operated and contacts R1B are open.

DETAILED DESCRIPTION

Figure 2:
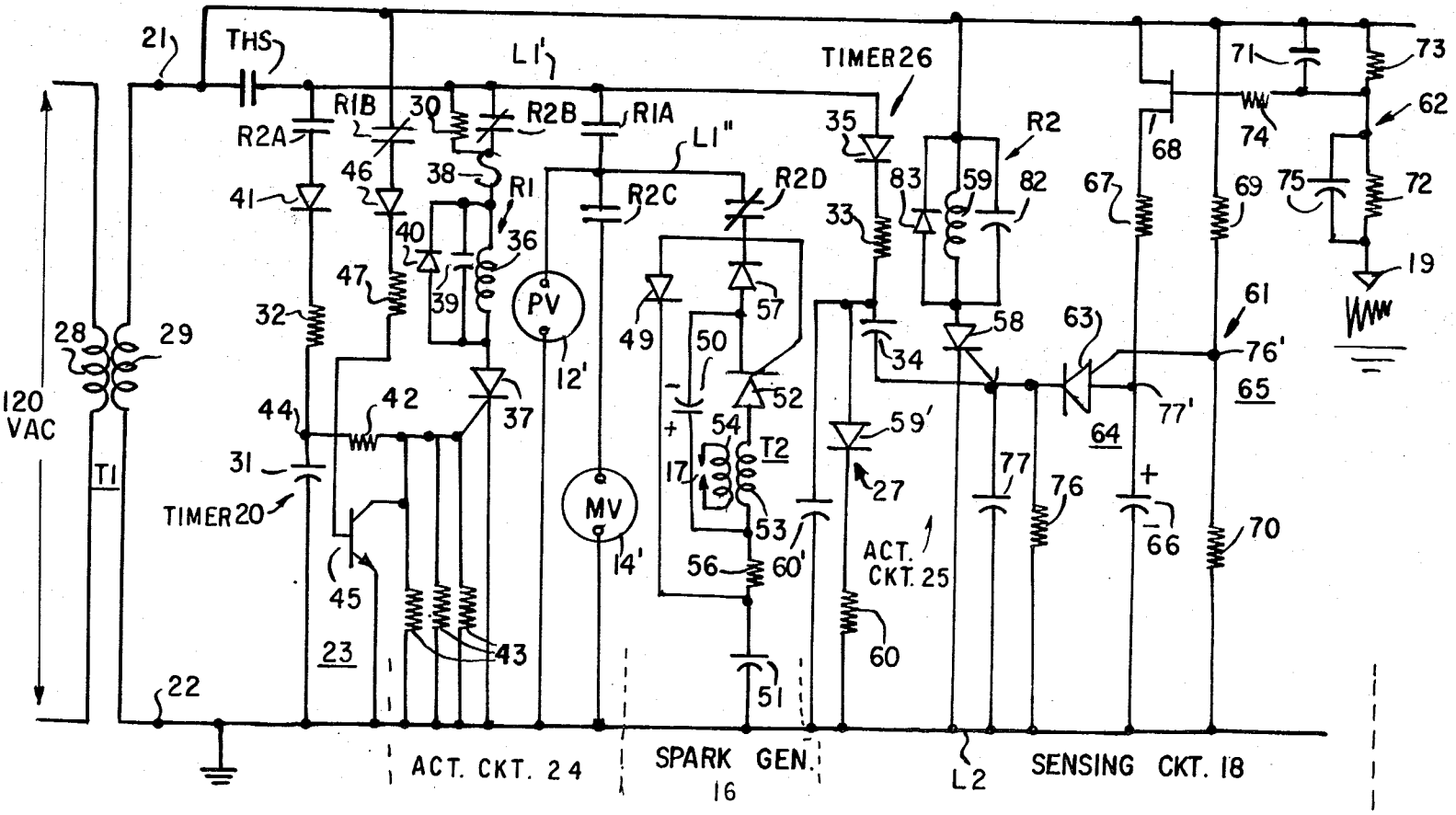
FIG. 2 is a schematic circuit diagram of the control system shown in FIG. 1.

Considering the control system 10 in more detail, with reference to FIG. 2, power is applied to the system 10 over an input transformer T1 which has a primary winding 28 connectable to a source of 120VAC and a secondary winding 29 connected to input terminals 21 and 22 to provide an energizing signal of approximately 24VAC between the input terminals. As indicated above, the flame sensing circuitry 18 is connected between conductors L1 and L2 which are connected to input terminals 21 and 22 respectively. The timing networks 20 and 26, the control relay R1, pilot and main valve solenoids 12' and 14', and the spark generating circuit 16 receive power from conductors L1' and L2, conductor L1' being energized whenever contacts THS are closed.

Considering the control relay R1 and its associated actuating circuit 24, the operate winding 36 of relay R1 is connected in a series energizing circuit with a controlled switching device 37 of the actuating circuit 24, which is embodied as a silicon controlled rectifier (SCR). The series energizing circuit extends from conductor L1′ over normally closed contacts R2B of relay R2, a fuse 38, operate winding 36 and the SCR device 37 to conductor L2. The winding 36 is energized whenever contacts THS and R2B are closed and the SCR device 37 is enabled. When relay R1 operates, contacts R1A close to extend AC power from conductor L1′ to a conductor L1″ to which are connected the spark generating circuit 16 and the pilot valve solenoid 12′. Also, contacts R1B open inhibiting reset network 23. A capacitor 39 and a free wheeling diode 40, which are connected in parallel with winding 36, maintain the relay operated during half cycles of the AC energizing signal during which the SCR device 37 is non-conducting. The fuse 38 affords protection against a shorted SCR device 37.

Capacitor 31 of ignition timer 20 is connected in a series charging circuit with contacts R2A, a diode 41 and a resistor 32 between conductors L1′ and L2, to permit the capacitor 31 to be charged whenever contacts THS and R2A are closed. The junction of resistor 32 and capacitor 31 at point 44 is connected over a resistor 42 to the gate of the SCR device 37. The SCR device 37 is armed by current flow from conductor L1′, diode 41 and resistors 32 and 42 and the gate-cathode circuit of the SCR device 37 while capacitor 31 is charging. When relay R2 is deenergized and its contacts R2B make, capacitor 31 discharges over resistor 42 and the gate-cathode circuit of the SCR device 37, enabling the SCR device 37 for a timed interval defined by the discharge time of the capacitor 31. In one circuit which was constructed in accordance with the principles of the invention and tested at a temperature of 75° F. and an applied voltage of 25VAC, the discharge time of capacitor 31 during trial for ignition was twenty seconds. For a flameout condition, following a successful ignition cycle, the discharge time for capacitor 31 was twenty-five seconds.

Thus, the capacitive timing network 20 and actuating circuit 24, which comprises an SCR device, provide a solid-state capacitive discharge enabling circuit for the control relay R1. Capacitive discharge timing is used because any fault in the capacitor will either shorten the trial for ignition period or reduce it to zero. Resistors 43 provide triple redundancy to assure that the time interval stays within acceptable limits even with two of the resistors 43 open.

The reset network 23, includes a transistor 45 having its collector-emitter circuit connected in parallel with capacitor 31 and resistor 42. The base of transistor 45 is connected to receive an enabling signal from conductor L1 over a series network including a diode 46 and a resistor 47 which are connected in series with normally closed contacts R1B between conductors L1 and the base of the transistor 45. When relay CR1 is deenergized, the transistor 45 is enabled during positive half cycles of the AC signal whenever contacts R1B are closed, providing a discharge path for the capacitor 31. However, the values of resistors 32 and 42 are selected so that capacitor 31 assumes a net charge as long as contacts THS and R2A remain closed.

When relay R1 is operated and contacts R1B are open, the transistor 45 is maintained disabled.

The spark generating circuit 16 is connected between conductors L1″ and L2 and is activated whenever contacts THS, R1A and R2D are closed. The spark generating circuit 16 is similar to one disclosed in my copending U.S. Patent Application Ser. No. 698,162 filed June 21, 1977, and now U.S. Pat. No. 4,077,762, and accordingly, will not be described in detail in the present application. Briefly, the spark generaing circuit 16 is of the capacitive discharge type and includes a capacitor 50 which is charged and then discharged over the primary winding 53 of an ignition transformer T2 during alternate half cycles of the AC line signal to provide sparks over the ignition electrodes 17 which are connected to the secondary winding 54 of the ignition transformer T2.

The spark generating circuit 16 includes a voltage doubler network including the capacitor 50 and a further capacitor 51 which enables the capacitor 50 to be charged to approximately twice the line voltage. Capacitor 51 is charged over a unidirectional charging path including a diode 49 during positive half cycles of the AC line voltage, that is when conductor L1′ is positive relative to conductor L2, and capacitor 50 is charged over a further unidirectional charging path including a diode 57 and capacitor 51 during the next negative half cycle of the AC line signal, with the charge on capacitor 51 being transferred to capacitor 50. During the next positive half cycle, when the AC signal starts to swing off peak, capacitor 50 begins to discharge over a path which extends from one side of the capacitor 50, through resistor 56 and capacitor 51 to conductor L2, through the secondary winding 29 of input transformer T1, contacts THS, R1A and R2D, and the gate to cathode of SCR device 52 to the other side of the capacitor 50. The SCR device 52 is thus enabled, providing a discharge path for the capacitor 50 over the primary winding 53 of the ignition transformer T2, with the discharge current inducing a voltage pulse in the secondary winding 54. The pulse is applied to the ignition electrodes 17, causing a spark to be provided therebetween adjacent to the pilot outlet 13. The spark generating circuit 16 continues to operate in this manner until the fuel is ignited at which time relay R2 is operated, opening contacts R2D, deenergizing the spark generating circuit 16.

Considering the actuating circuit 25, and the cycling timer 26 which cycles the flame relay R2 on and off at the start of a heating cycle, the actuating circuit includes an SCR device 58 which is connected in series with an operate winding 59 of the relay R2 between conductors L1 and L2. When enabled, the SCR device 58 provides an energizing path for winding 59, permitting the relay R2 to operate. The cycling timer 26 supplies gate current to the SCR device 58 to enable the SCR device 58 at the start of a heating cycle. The flame sensing circuitry 18 provides gate current to the SCR device 58 to enable the SCR device 58 when a flame is established at the burner.

More specifically, the timing network 26 comprises , resistor 33, a capacitor 34 and a diode 35 which are connected in series between conductor L1′ and the gate of the SCR device 58. Accordingly, when conductors L1′ and L2 are energized in response to the closing of contacts THS, current flows from conductor L1′ through the circuit path including capacitor 24 and through the gate-cathode circuit of the SCR device 58 to conductor L2. This enables the SCR device to conduct thereby effecting energization of winding 59 of relay R2. When capacitor 34 is charged, after approximately two seconds, current flow ceases and the SCR device 58 is disabled, so that relay R2 drops out, permitting the timing network 20 to enable relay R1 via actuating circuit 24 to effect operation of the pilot valve and spark generating circuit. When a pilot flame is established, the flame sensing circuitry 18 reenables the relay R2 via actuating circuit 25 to effect operation of the main valve and maintain the valve operated as long as a flame is sensed and contacts THS are closed. The reset network 27, including a diode 59', a resistor 60 and a capacitor 60', provide a discharge path, via resistor 76, for the capacitor 34 when contacts THS open.

The flame sensing circuitry 18 includes a control section 61 and a flame sensing network 62. The control section 61 includes a controlled switching device 63, embodied as a programmable unijunction transistor, which is operable under the control of an anode control network 64 and a gate control network 65 to enable the SCR device 58 whenever a pilot flame is established.

The anode control network 64 includes a further controlled switching device 68, embodied as a field effect transistor (FET), and a capacitor 66 and resistor 67 which are connected in series with the source to drain circuit of the FET device 68 between conductors L1 and L2. The junction of capacitor 66 and resistor 67 at point 77' is connected to the anode of the PUT device 63, with the charge on the capacitor 66 determining the anode potential.

The gate control network 65 includes resistors 69 and 70 which are connected in series between conductors L1 and L2. The junction of resistors 69 and 70 at point 76' is connected to the gate of the PUT device 63, enabling an AC reference voltage to be established at the gate of the PUT device whenever power is conductors L1' and L2. The PUT device 63 is enabled whenever the anode potential exceeds a potential by +0.6 volts.

The FET device 68, which for example, may be an N-channel, depletion mode field-effect transistor such as the type 2N5458, controls the charging of the capacitor 66. The FET device 68 is in turn controlled by the flame sensing network 62 to conduct whenever its gate potential is positive with respect to its source potential. In the absence of a flame, network 62 enables the FET device 68 to conduct current during both positive and negative half cycles of the AC signal resulting in an average charge of zero volts on the capacitor 66. Thus, the anode to gate potential for the PUT device remains cut off. When a flame is established, network 62 enables the FET device 68 to conduct current during positive half cycles but causes it to be "pinched off" during negative half cycles so that capacitor 66 charges to a value which permits the anode potential to exceed the gate potential by +0.6 volts, thereby enabling the PUT device 63. The PUT device 63 is pulsed into operation, providing an enabling pulse for the SCR device 58 for a portion of each cycle of the AC signal. During the time that the SCR device 58 is nonconducting, in response to the current reversal at the start of the negative half cycle of the AC signal, the relay R2 is maintained energized by capacitor 82 and free wheeling diode 83 which are connected and parallel with the operate winding 59 of the relay R2.

When the PUT device 63 conducts, capacitor 66 discharges over the PUT device 63, and resistor 76 providing gate current for enabling the SCR device 58 to operate the relay R2.

As indicated above, the conductivity of the FET device 68, which controls the charging of capacitor 66, is controlled by the flame sensing network 62 which establishes the gate potential for FET device 68. The flame sensing network 62 includes a capacitor 71, resistors 72–74, and flame sensing electrode 19. Resistor 72 and the flame sensing electrode 19 provide a charging path for capacitor 71, permitting the capacitor to be charged by flame rectified current whenever a pilot flame is established. The sensing electrode 19 is located in the proximity of the pilot outlet 13 in a spaced relationship therewith, defining a gap there between. The pilot outlet 13 is connected to ground reference point for the system 10.

In the absence of a flame, the charging circuit for capacitor 71 is virtually an open circuit, preventing the capacitor from charging so that the FET device 68 conducts during both positive and negative half cycles of the AC signal. When a flame bridges the gap between the sensing electrode 19 and the ground reference, capacitor 71 is charged by flame current conducted over the flame and sensing electrode 19 and through resistor 74 to the capacitor 71, causing the FET device 68 to become "pinched off" during negative half cycles of the AC signal, permitting capacitor 66 to assume a net charge. Resistor 73, which is connected in parallel with capacitor 71 provides a bleeder path for the capacitor 71, and capacitor 75 minimizes spark RF interference.

OPERATION

When the primary winding 28 of the input transformer T1 is connected to a 120 VAC source, the secondary winding 29 supplies 24 VAC to input terminals 21 and 22 which is extended via conductors L1 and L2 to the flame sensing circuitry 18, independently of the thermostatically controlled contacts THS.

When contacts THS close in response to a request for heat, the 24 VAC power is extended to conductors L1' and L2, and current flows over diode 35, resistor 33, capacitor 34 and the gate to cathode circuit of SCR device 58 to conductor L2, enabling the SCR device 58. The SCR device 58 conducts, effecting energization of winding 59 of relay R2 which operates to close contacts R2A, connecting timing network 20 between conductors L1' and L2. Current then flows from conductor L1' over diode 41, resistor 32 and capacitor 31 to conductor L2, charging the capacitor. As long as contacts THS and R2A remain closed, the potential at point 44 prevents the capacitor 31 from discharging. It is pointed out that although current also flows from point 44 over resistor 42 and the gate to cathode circuit of the SCR device 37, arming the device, relay R2 cannot operate since contacts R2B of relay R2 are open at this time.

When capacitor 34 of timing network 26 becomes fully charged, this interrupts current flow over the gate to cathode circuit of SCR device 58 which then is maintained non-conducting, interrupting the energizing path for the winding 59 of relay R2 so that the relay drops out, opening contacts R2A and reclosing contacts R2B. It is pointed out that when relay R2 drops out after being cycled by cycling timer 26 during startup, the checking relay contacts R1B are initially closed so that reset transistor 45 is enabled. Capacitor 31 begins to discharge into network 23 before relay R1 operates, but only for a few milliseconds, the time required for relay R2 to transfer, opening contacts R2A and closing contacts R2B. During this time, the charge on capacitor 31 drops very little.

When contacts R2A open, capacitor 31 begins to discharge over resistor 42 and the gate to cathode circuit of the SCR device 37 which is then enabled and completes the energizing path for the winding 36 of relay R1 since contacts R2B are now closed. Relay R1 then operates closing its contacts R1A to energize the pilot valve solenoid 12' and to activate the spark generating circuit 16. Also, contacts R1B open, inhibiting the discharge network 23.

Referring to the flame sensing circuitry, when the pilot fuel is ignited and flame bridges the gap between the sensing electrode 19 and ground point, currents flows from conductor L1 through capacitor 71 and resistor 72 to electrode 19, through the flame and to ground. The flame both conducts and rectifies the current, providing a DC current for charging the capacitor 71 so that FET device 68 is "pinched off" during negative half cycles because the gate potential is negative with respect to the source potential.

Accordingly, during positive half cycles of the AC line signal, current flows through the FET device 68 the resistor 67 and the capacitor 66 charging the capacitor 66 to the polarity indicated in FIG. 2. The voltage on the capacitor 58 is applied to the anode electrode of the PUT device 55. The values for the resistor 67 and the capacitor 66 are chosen so that the time required for the charge on capacitor 66 to exceed the gate voltage established by the voltage dividing resistors 69 and 70 is greater than one cycle of the AC line signal, and may for example be in the order of four cycles. Thus, when the voltage on the capacitor 66 raises the anode potential for the PUT device 63 to a value that is +0.6 volts greater than the reference voltage established at the gate of the PUT device by resistors 69 and 70, the PUT device 63 conducts and discharges the capacitor 66 into the gate of the SCR device 58 which then conducts, energizing the operate winding 59 of relay R2. The relay operates to close contacts R2A and R2C, enabling current to flow over timing network 20 to maintain relay R1 operated, and to energize the operate solenoid 14' of the main valve 14, so that the main valve 14 operates to supply fuel to the main burner 15 for ignition by the pilot flame. Also contacts R2D open, to deactivate the spark generating circuit 16, and contacts R2B open to interrupt the low impedance energizing path relay winding 36, which is maintained energized over resistor 30.

For a flame out condition, or before a flame is established at start-up, the FET device 68 is a low resistance element in the anode control network 64, and conducts during both positive and negative half cycles of the AC line signal. Accordingly, since AC current is conducted in both directions, over the anode control network 64, this results in an average net charge of zero volts on the capacitor 66. Therefore, the PUT device 63 is held cutoff and the relay R2 is deenergized.

When the heating demand has been met, contacts THS open, deenergizing relay R1 and the fuel valves 12 and 14, interrupting the supply of fuel to the burner. The flame sensing circuit 18 responds to the loss of flame to cause relay R2 to drop out, opening contacts R2A and R2C and closing contacts R2B and R2D. Relay R1 opens contacts R1A and closes contacts R1B, permitting current to flow from conductor L1 through diode 46, resistor 47 and the base-emitter of transistor 45, which then conducts. This permits capacitor 31 to discharge over the resistor 42 and the collector-emitter of transistor 45. Also, capacitor 34 discharges over diode 59', resistor 60, and resistor 76, and the system 10 is prepared for the next ignition cycle.

The discharge network 23 is energized during the time that contacts THS are open, and transistor 45 is conducting. Thus, in the case of a short circuit failure of capacitor 34 of the cycling timer 26, the discharge network 23 is effective to discharge capacitor 31 of the ignition timer 20 sufficiently to prevent operation of relay R1 before relay R2 operates to open contacts R2B, even with rapid recyling of contacts THS. During rapid recyling of the thermostat contacts THS, relays R1 and R2 would be deenergized for a time interval in the order of several seconds. Capacitor 31 is permitted to discharge over the discharge network 23 during this time interval which is considerably longer than the transfer time for relay R2, a few milliseconds for a normal start-up. Stated in another way, the discharge network 23 is effective to discharge capacitor 31 sufficiently to prevent enabling of relay R1 before relay R2 operates under the fault condition mentioned above. However, the discharge network does not cause capacitor 31 to discharge to the point where relay R1 cannot be enabled during a normal operating cycle.

SECOND EMBODIMENT

Figure 3:
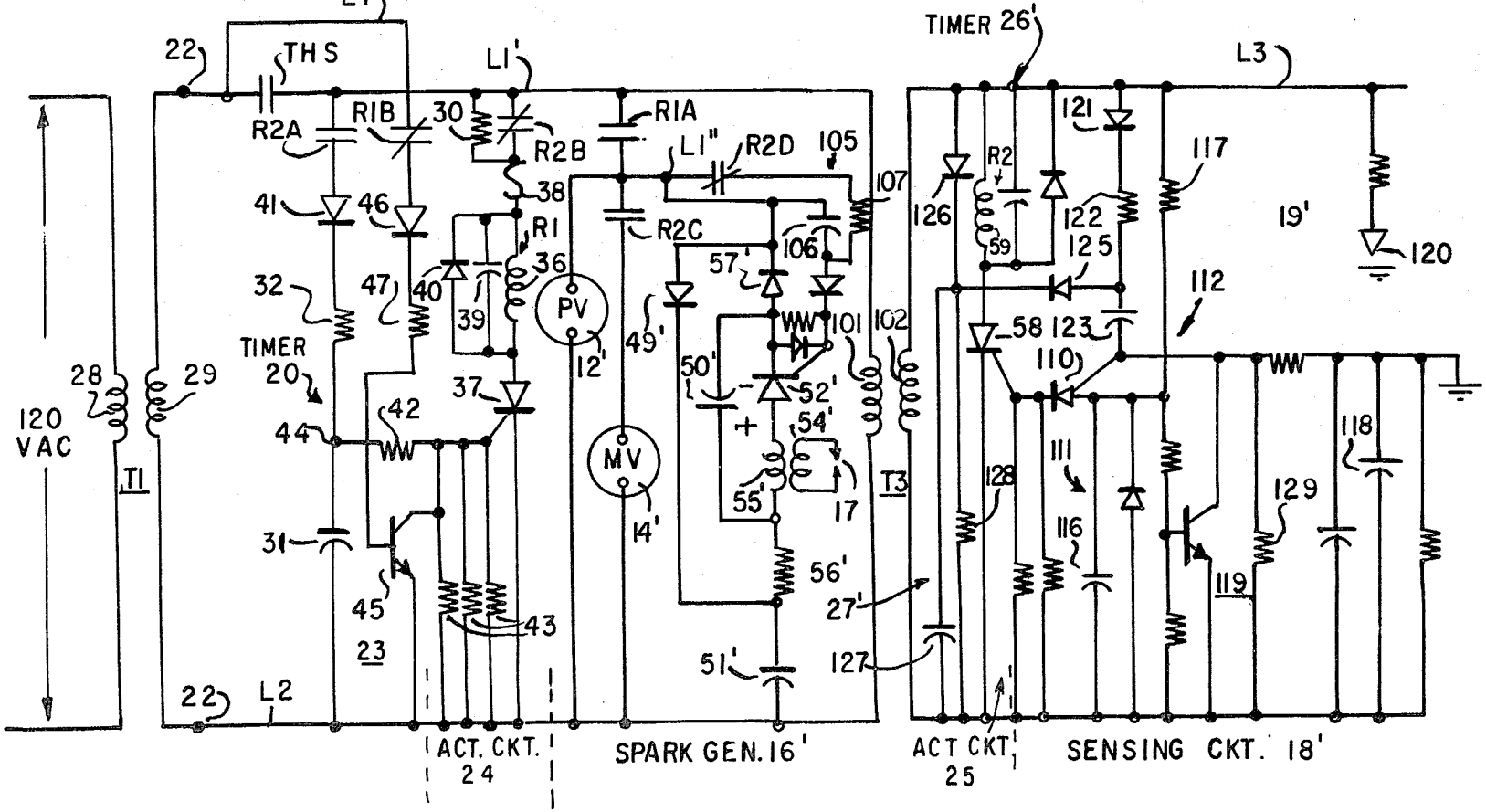
FIG. 3 is a schematic circuit diagram of a control system which is similar to the one shown in FIG. 2 but employs different flame sensing circuitry.

Referring to FIG. 3, there is shown a schematic circuit diagram of a second embodiment for a control system 100 for use in a heating system. The control system 100 includes flame relay R2, ignition timer 20, and relay R1 which control the pilot valve 12, and the main valve 14 as described for the system shown in FIG. 2, and accordingly, like elements have been given the same reference numbers.

The control arrangement 100 employs a different flame sensing circuitry 18' for enabling the flame relay R2. When a flame and a cycling timer 26' which cycles the flame relay R2 on and off at the start of an operating cycle as in the system 10. Also, the flame sensing circuitry 18' is not continuously energized, but rather is energized via transformer T3 in response to the closing of contacts THS. The spark generating circuit 16' is generally similar to the spark generating 16 shown in FIG. 2, but includes a timing network 105 which permits the spark generating circuit 16' to provide a lingering spark for a predetermined time, such as five to ten seconds, after the relay R2 operates to disable the spark generating circuit 16'. Elements of spark generating circuit 16' have been given the same reference numeral with a prime notation, as like element of spark generating circuit 16.

Considering the control system 100 in more detail, the connections of the pilot valve 12, main valve 14, relay R2, timing network 20 and actuating circuit 24 as well as the connections to a source of AC power are the same as described above with reference to FIG. 2, and will not be repeated here. However, it is pointed out that flame sensing circuitry 18' is not connected to conductor L1, but rather is energized by AC power provided over transformer T3 which has a primary winding 101 connected between conductors L1' and L2, and a secondary winding 102 connected between conductors L3 and L4 which extend power to the flame sensing circuitry, 18'.

The spark generating circuit 16' is similar to one disclosed in my U.S. Patent Application Ser. No. 698,162, now U.S. Pat. No. 4,077,762 and thus will not be described in detail. The spark generating circuit 16' is connected between conductors L1' and L2 for energization thereover whenever contacts THS, R1A and R2D are closed. As is fully described in the referenced application, prior to the operation of relay R2, the spark generating circuit 16' receives energizing current from conductor L1' over normally closed contacts R2D of relay R2 and a resistor 107. When relay R2 operates and contacts R2D open, the spark generating circuit 16' receives energizing current from conductor L1' over a timing capacitor 106 of the timing network 105, which is normally shunted by contacts R2D and resistor 107. Thus, when contacts R2D are open, the spark generating circuit 16' continues to be energized over capacitor 106 for a given time, in the order of ten seconds, defined by the charging time of the capacitor 106. When the capacitor 106 is charged, the spark generating circuit 16' is inhibited and spark generation is terminated.

The flame sensing circuitry is similar to that disclosed in my U.S. Pat. No. 4,047,878 and accordingly will not be described in detail herein. Briefly, the flame sensing circuitry includes a controlled switching device, embodied as a programmable unijunction transistor 110, which is controlled by an anode network 111 and a gate network 112 to effect the enabling of the SCR device 58 which controls the operation of relay R2. The anode control network 111, which includes a capacitor 116, determines the potential at the anode electrode of the PUT device 110. The gate control network 112, which includes redundant timing capacitors 118, determines the potential at the gate of the PUT device 110.

The PUT device 110 is enabled whenever the potential at its anode exceeds the potential at its gate by +0.6 volts. Capacitor 116, which determines the potential at the anode of the PUT device 110, is periodically charged over a resistor 117 by an AC signal which is supplied to the flame sensing circuitry over an isolation transformer T3 and conductors L3 and L4, when contacts THS are closed. Normally, in the absence of a flame, capacitors 118 remain essentially uncharged, such that the enabling of the PUT device 110 is effectively controlled by the charging of capacitor 116. When the PUT device 110 is enabled, capacitor 116 discharges into the gate of the SCR device 58. However, such discharge current is insufficient to enable the SCR device 58, and the relay R2 remains deenergized.

For the purpose of permitting relay R2 to be energized for a short time at the start of an operating cycle, the cycling timer 26' responds to application of power to conductors L3 and L4 to control the potential at the gate of the PUT device 110 to allow capacitor 116 to charge to a value which provides sufficient discharge current for enabling the SCR device 58.

The timing network 26' includes a diode 121, a resistor 122 and a capacitor 123 which are connected in series between conductor L3 and the gate of the PUT device 110.

When power is supplied to conductors L3 and L4 when contacts THS close, the capacitor 123 charges while capacitor 116 is charging. Although capacitor 116 charges at a faster rate, the charging of capacitor 123 raises the potential at the gate of the PUT device 110 so that a longer time is now required before the potential at the anode exceeds the potential at the gate by +0.6 volts. Thus, when the PUT device 110 is enabled, the capacitor 116 has been charged to a value which provides sufficient discharge current to enable the SCR device 58, causing the relay R2 to be energized. The timing network 26' causes the SCR device 58 to be enabled during a period of approximately two seconds, which is defined by the charging time of capacitor 123.

A fast discharge network 27', comprised of diodes 125 and 126, a capacitor 127 and a resistor 128, effect discharge of capacitor 123 when contacts THS open at the end of each heating cycle.

For the purpose of permitting relay R2 to be energized when a flame is established, the flame sensing circuitry further includes a flame sensing electrode 19' which is located in the proximity of the grounded pilot outlet 13 in a spaced relationship defining gap 120 therebetween.

When fuel supplied to the pilot outlet 13 is ignited, the flame bridges the gap 120 establishing a charging path for the capacitors 118. Accordingly, flame current flows over the path causing the capacitors 118 to charge while capacitor 116 is charging. Although capacitor 116 charges at a faster rate, the charging of capacitors 118 raises the potential at the gate of the PUT device 110 so that a longer time is now required before the potential at the anode exceeds the potential at the gate by +0.6 volts. Thus, when the PUT device 110 is enabled, the capacitor 116 has been charged to a value which provides sufficient discharge current to enable the SCR device 58, causing the relay R2 to be energized. An oversignal clamping network 119 limits the gate potential as described in the referenced patent.

OPERATION

Briefly, in operation, when contacts THS close in response to a request for heat, AC power is applied to conductors L3 and L4, energizing the flame sensing circuitry 18'. Accordingly, current flows from conductor L3 through diode 121, resistor 122, and capacitor 123, and resistor 129 to conductor L4 to increase the voltage on the gate of the PUT device 110, thereby simulating a flame signal. Since current also flows from conductor L3 through diode 126 and capacitor 127 to conductor L4 and charges the capacitor 127, diode 125 is reverse biased to prevent rapid discharge of capacitor 123. Thus, capacitor 116, which is also charging via resistor 117 is permitted to charge to a value providing sufficient discharge current for enabling the SCR device 58 when the PUT device 110 is enabled.

This causes SCR device 58 to conduct and energize relay R2 until capacitor 123 is charged, which will remove the signal from the gate of the PUT device. The charge time for the capacitor 123 may, for example, be approximately two seconds.

During the time relay R2 is energized, capacitor 31 of ignition timer 20 is initialized as previously described with reference to FIG. 2. When relay R2 is deenergized with the timeout of cycling timer 26', that is when capacitor 123 becomes fully charged, then the SCR device 37 is enabled by discharge current of timing capacitor 31 and conducts to energize relay R1.

When relay R1 operates, the pilot valve 12 is energized and operates to supply fuel to the pilot outlet 13 for ignition by sparks provided by the spark generating circuit 16' which is also energized at this time.

When a pilot flame is established and impinges on the electrode 19' of the flame sensing circuitry 18', the flame sensing circuitry 18' is operable in the manner described above, with the PUT device 110 being controlled to permit capacitor 116 to charge to a value before the PUT device 110 is enabled. When the PUT device is enabled, the capacitor 116 discharges into the gate of the SCR device 58 which conducts to reenergize relay R2. When relay R2 operates, contacts R2A reclose extending holding current to timing capacitor 31 which maintains the SCR device 37 and thus relay R1 operated. Also contacts R2C close to effect the energization of the main valve 14 which operates to supply fuel to the main burner 15 for ignition by the pilot flame, and contacts R2D open, disabling the spark generating circuit 16'. However, the spark generating circuit 16' is maintained operable by the timing capacitor 106 to provide a lingering spark for approximately ten seconds after relay R2 operates.

The operation of the control system 100 from this point to the end of the heating cycle is generally similar to that for the control system 10 previously described with reference to FIG. 2. However, in the system 100 the flame sensing circuitry 18' is deenergized when contacts THS open. Also, the reset network 27' for timing capacitor 123 operates as follows. When contacts THS open, capacitor 127 discharges over resistor 128, removing the reverse bias from diode 125. The diode 125 conducts to allow capacitor 123 to discharge through diode 125, resistor 128 and resistor 129.

As indicated, in this embodiment, the flame sensing circuitry 18' is not connected ahead of the thermostat contacts THS as in FIG. 2 where such connection assures that if a fault exists in the flame sensing circuitry 18, relay R2 is energized before relay R1 so that the integrity check is provided. If the flame sensing circuitry 18' were continuously energized, capacitor 123 would charge up when THS contacts were open, preventing operation of relay R2 when contacts THS close and locking out the system. In system 100, the reset network 23, discharges capacitor 31 when contacts THS are open so that when contacts THS reclose, relay R2 can be operated before relay R1. As indicated above for fast recycle of contacts THS following lockout, relays R1 and R2 are deenergized for several seconds, allowing reset network 23 to discharge capacitor 31 sufficiently so that when the contacts THS reclose, relay R1 does not operate before relay R2 operates.

As a redundancy back-up, the lingering spark circuit 16' is utilized so that in the event of a fault in the flame sensing circuit 18' and a fault in the discharge circuit, a spark will be generated for a period of 5 to 10 seconds after relay R2 operates. This will ignite, or reignite, the burner, and lockout can occur on the next normal cycle.

THIRD EMBODIMENT

Figure 4:
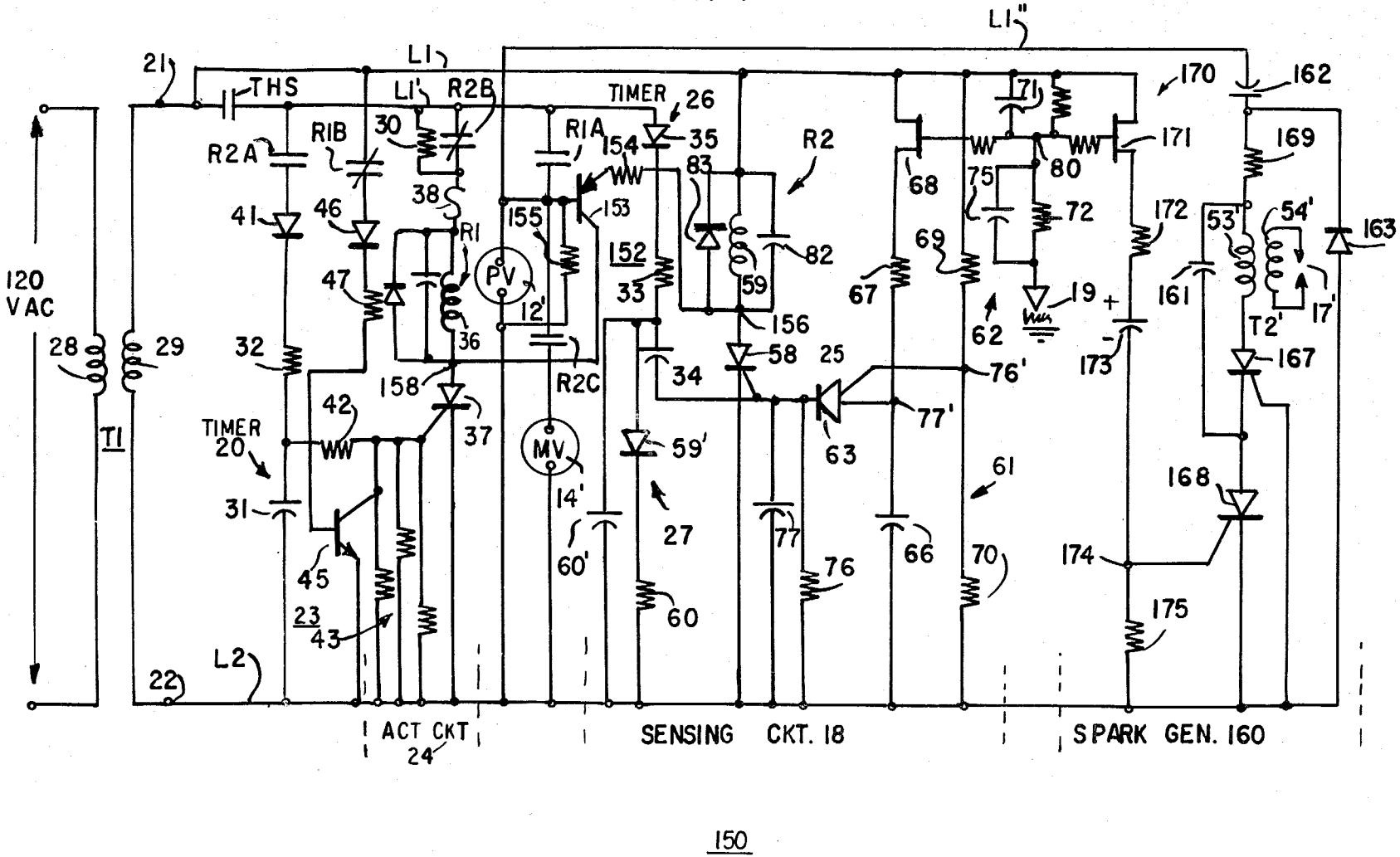
FIG. 4 is a schematic circuit diagram of a control system which is similar to the one shown in FIG. 2 but employs a flame responsive spark generator.

Referring to FIG. 4, there is shown a schematic circuit diagram for a third embodiment of a control system 150 for use in a heating system. The control system 150 employs elements of the control system 10 including relays R1 and R2, ignition timer 20, cycling timer 26, and the flame sensing circuitry 18, for controlling the operation of a pilot and main valves of the system, and accordingly, the same or similar elements have been given the same reference numerals.

In addition, the control system includes a spark generating circuit 160, the operation of which is conditioned on the presence or absence of a flame and independent of the flame sensing circuitry 18. Therefore, any fault that might occur in the flame sensing circuitry 18 will not affect the operation of the spark generating circuit 160 and its relation with the flame.

The connections and operation of the fuel valves 12 and 14, the timing networks 20 and 26 the control relay R1, and the flame sensing circuitry 18, along with relay R2 have been set forth in detail in the foregoing description with respect to the arrangement 10 shown in FIG. 2.

Regarding the actuating circuit 24', a control network 152 comprises a transistor 153, and resistors 154 and 155. The emitter of the transistor 153 is connected over resistor 154 to the junction of relay winding 59 of relay R2 and the anode of SCR device 58 at point 156. The base of transistor 153 is connected to conductor L1" at the junction of contacts R1A and R2C, and over resistor 155 to conductor L2. The collector of transistor 153 is connected to the anode of SCR device 37 at point 158.

Basically, the transistor 153 operates as a switch which is normally closed when contacts THS are open, connecting one side of the relay winding 59 to the anode of SCR device 37 so that if, due to a fault, it is acting as a diode, the relay R2 is operated, locking out the system. The transistor 153 is inhibited during a normal operating cycle when contacts R1A of relay R1 close, connecting power to conductor L1". This control network 152 prevents the pilot valve 12 from being operated open following a flame out and a dioding condition for SCR 37.

The spark generating circuit 160 is similar to one disclosed in my U.S. Patent Application Ser. No. 790,408 which was filed Apr. 25, 1977 and now U.S. Pat. No. 4,178,149. The spark generating circuit is of the capacitor discharge type and includes a capacitor 161 which is charged and then discharged over the primary winding 53' of an ignition transformer T2' during alternate half cycles of the AC line signal to provide sparks over ignition electrodes 17' which are connected to the secondary winding 54' of the transformer T2'.

The spark generating circuit 160 includes a voltage doubler network including capacitor 161 and a further capacitor 162 which enables the capacitor 161 to be charged to approximately twice the AC line voltage. The circuit 160 also includes a flame responsive enabling network 170, including a controlled switching device, embodied as a Type 2N5458 field effect transistor 171, and a timing capacitor 173, which permits the spark generating circuit 160 to operate to generate sparks in the absence of a flame and which causes the circuit 160 to be disabled whenever a flame is established.

Considering the spark generating circuit 160 in more detail, capacitor 162 is connected in a unidirectional charging path with a diode 163 between conductor L2 and conductor L1" to be charged during negative half cycles of the AC line signal when power is applied to conductors L1" and L2. Capacitor 161 is connected in a series charging path which extends from conductor L1" over capacitor 162, a resistor 169, the capacitor 161 and a normally disabled silicon controlled rectifier 168 to conductor L2, permitting capacitor 161 to be charged during positive half cycles of the AC line signal whenever the SCR device 168 is conducting. The SCR device 168 is enabled by the enabling network 170 during positive half cycles of the AC line signal whenever a flame is not impinging on the flame sensing electrode 19.

The primary winding 53' of the transformer T2' is connected in series with a further SCR device 167 and in parallel with capacitor 161 to provide a discharge path for capacitor 161 over the primary winding 53' whenever the SCR device 167 is conducting. The discharge current induces a voltage pulse in the secondary winding 54' of the transformer T2, which is applied to the ignition electrodes 171 which are connected to the secondary winding 54', causing a spark to appear in the gap between the electrodes 17'. The electrodes are positioned adjacent to the pilot outlet 13 to permit the sparks to ignite pilot fuel emanating therefrom.

Referring to the enabling network 170, timing capacitor 173 is connected in a series charging path with the FET device 171, the path extending from conductor L1 over the drainsource circuit of the device 171, and a resistor 172 to one side of the capacitor 173, and from the other side of the capacitor 173 at point 174 over a resistor 175 to the conductor L2. The gate of the FET device 171 is connected over a resistor 176 to point 80 at the junction of capacitor 71 and resistor 72 of the flame sensing network 62. The gate of SCR device 168 is connected to point 174.

OPERATION

When AC power is supplied to the control system 150 over input transformer T1, the flame sensing circuitry 18' is energized via conductors L1 and L2. Also, current flows from conductor L1 through the operate winding 59 of relay R2, through resistor 154, emitter-base of transistor 153 and resistor 155 to conductor L2. The resistors 154 and 155 limit the current to a level which is insufficient to permit relay R2 to operate, but which enables transistor 153 to conduct from emitter to collector, effectively connecting one side of relay winding 59 to the anode of the SCR device 37. When the SCR device 37 is functioning properly, it is non-conducting when contacts THS are open. However, for a failure of the SCR device 37 which permits it to act as a diode, then current flow from conductor L1, through relay winding 59, resistor 154, the emitter-collector of transistor 153 and the faulty SCR device to conductor L2, will enable relay R2 to operate and open contacts R2B to lock out the system.

Assuming the SCR device 37 is functioning properly, then the operation of the control system 150 is generally the same as previously described for the control system 10 shown in FIG. 2. That is, when contacts THS close in response to a request for heat, relay R2 is operated to initialize timing circuit 20, and when relay R2 drops out, timing circuit 20 enables relay R1 which operates to connect power to conductor L1". Accordingly, the pilot valve 12 operates to supply fuel to the pilot outlet 13 for ignition, and the spark generating circuit 160 is activated. Also, transistor 153 is cutoff, isolating relay R2 from the SCR device 37.

Referring to the spark generating circuit 160, prior to ignition of the pilot fuel, capacitor 71 of the flame sensing network 62 is discharged, and the FET device 171 conducts AC current during both positive and negative half cycles. The AC current flow through the FET device 171, resistor 172, capacitor 173, and resistor 175 causes the SCR device 168 to conduct.

During negative half cycles, capacitor 162 is charged over diode 163 and during positive half cycles, when the SCR device 168 is conducting, capacitor 161 is charged over capacitor 162 with the charge on capacitor 162 being transferred to capacitor 161. When conductor L2 becomes positive with respect to conductor L1", the SCR device 168 is cutoff. At such time, the voltage on the capacitor 161 is greater than the line voltage and capacitor 161 begins to discharge permitting current to flow from one side of the capacitor 161 over resistor 169 and capacitor 162 to conductor L1", through the pilot valve solenoid 12' to conductor L2, and over the gate-cathode circuit of the SCR device 167 to the other side of the capacitor 161, causing the SCR device 167 to conduct. The capacitor 161 then discharges over the primary winding 53' of the ignition transformer T2 inducing a voltage pulse in the secondary winding 54' which is applied to the electrodes 17' causing a spark to be generated. The above operation continues until the pilot fuel is ignited.

When a flame impinges on the flame sensing electrode 19, capacitor 71 becomes charged and the flame sensing circuitry 18' operates as described above with reference to circuit 18 in FIG. 2, cause relay R2 to operate and energize the main valve 14.

Also, when capacitor 71 of the flame sensing network 62 is charged, the potential at point 80 causes the FET device 171 to be "pinched-off" during negative half cycles of the AC signal. Accordingly, during positive half cycles, capacitor 173 charges over the FET device 171 and resistors 172 and 175, and after a time delay established by the charging time of the capacitor 173, prevents further current flow to the gate of the SCR device 168. Thus, the spark generating circuit 160 is disabled, and spark generation is terminated as long as a flame impinges on the flame sensing electrode 19.

In response to a loss of flame, the FET device 171 again conducts current in both direction during each AC cycle, thereby enabling the spark generating circuit 160 to generate sparks for reigniting the fuel. The spark generating circuit 160 is therefore responsive to the flame and independent of the flame sensing circuitry except for deriving its control signal from the flame sensing network 62 which includes only passive components. For a failure of the flame sensing network 62, such as an open or short circuit condition for capacitor 71, the FET device 171 is maintained conducting as long as relay R1 is operated, and thus, the spark generating circuit 160 operates to generate sparks continuously.

The deactivation of the system, including the operation of reset networks 23 and 27, at the end of the heating cycle has been described above with reference to FIG. 2.

FOURTH EMBODIMENT

Figure 5:
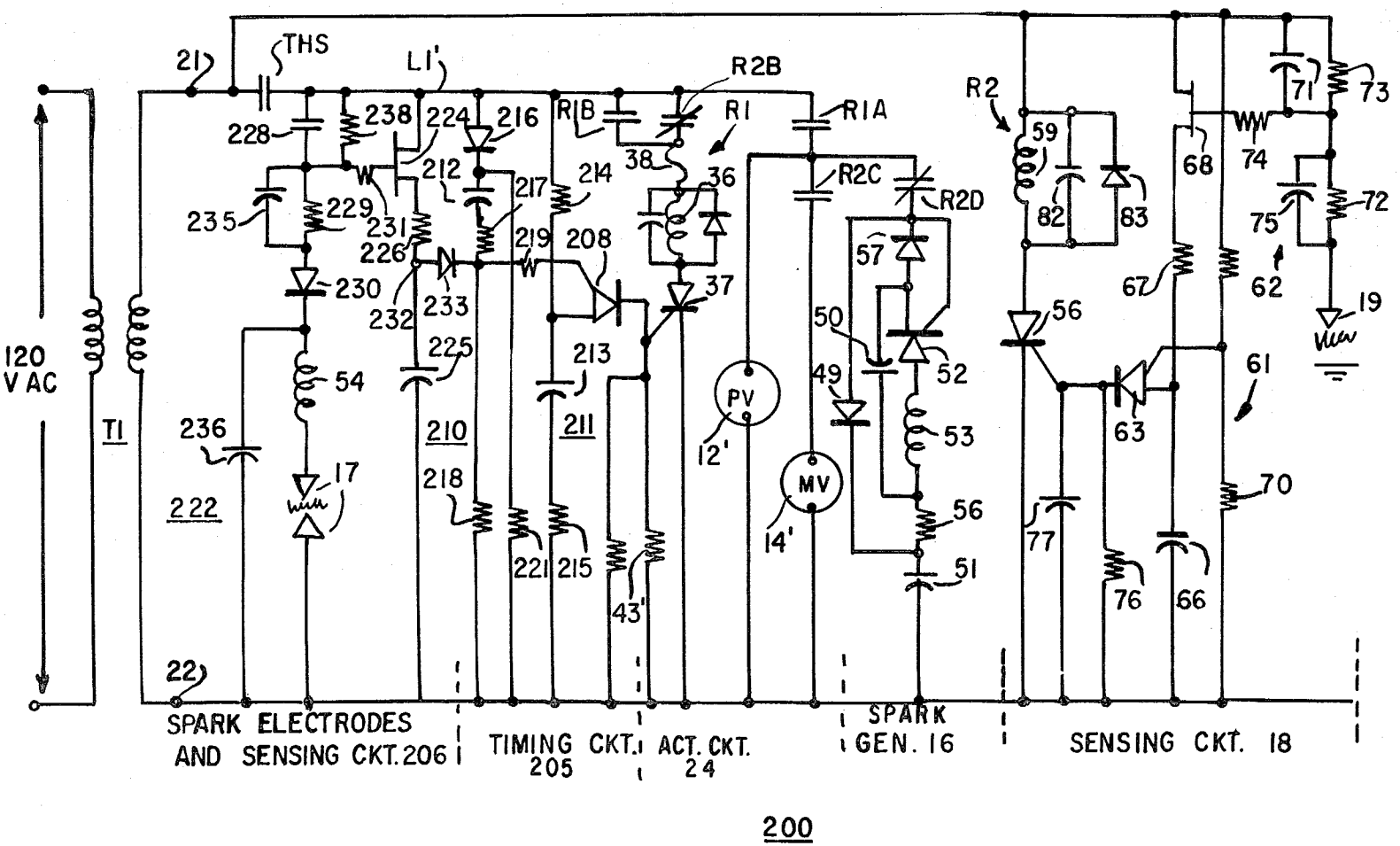
FIG. 5 is a schematic circuit diagram of a control system provided by the present invention which employs separate flame sensing circuitry for controlling the operation of the checking relay and the flame relay.

In FIG. 5 there is shown a schematic circuit diagram for a fourth embodiment of a control system 200 provided by the present invention for use, for example in a heating system for controlling pilot valve, and main valve of the system. The control system 200 includes the flame sensing circuitry 18, and the spark generating circuit 16 employed in the arrangement 10 shown in FIG. 2. The system 200 employs relays R1 and R2 and associated actuating circuits 24 and 25 which are similar to those shown in FIG. 2. Accordingly, the same or similar elements have been given the same reference numerals.

In this arrangement 200, the operation of relay R1 is effected by a timing circuit 205 which has a separate flame sensing channel 206 that utilizes the spark electrodes 17 as a flame sensor, thereby providing two separate independent flame sensors and associated circuits for controlling the operation of relays R1 and R2. The timing circuit 205 is not initiated at the start of an operating cycle by enabling relay R2, but rather responds to operation of the thermostatically controlled switch contacts THS to effect enabling of the checking relay R1 over the actuating circuit 24 during a trial for ignition interval. The timing circuit 205 disables the checking relay R1 thereby effecting shutdown of the system in the event a flame fails to be established within such time.

The connections and operation of the fuel valves, the spark generating circuit, the flame sensing circuitry and relay R2, and the checking relay R1 have been set forth in detail in the foregoing description with respect to the control system 10 shown in FIG. 2. However, in this embodiment, contacts R1B of relay R1 provide a holding path for the relay, and contacts R2A of relay R2 are not used.

The timing circuit 205 includes a controlled switching device 208, embodied as a programmable unijunction transistor (PUT) having associated gate and anode control networks 210 and 211 which include respective timing capacitors 212 and 213 which control the enabling of the PUT device 208. The capacitors 212 and 213 are permitted to charge in response to current flow thereover when contacts THS close, permitting the timing circuit 205 to provide an enabling signal via PUT device 208 for the SCR device 37 of actuating circuit 24. Capacitor 212 is connected in a unidirectional charging path and thus becomes fully charged at a predetermined time, or trial for ignition period, after contacts THS close. If ignition fails to occur prior before capacitor 212 becomes fully charged, the PUT device 208 is thereafter maintained disabled, inhibiting the SCR device 37 and causing the checking relay R1 to be deenergized.

If ignition is successful, a further control, or flame sensing network 222, including the sensor electrodes 17, a field effect transistor 224 and a timing capacitor 225 provides an enabling potential for the PUT device 208, permitting the device to continue to be enabled after the end of the trial for ignition interval, thereby maintaining the checking relay R1 operated.

More specifically, timing capacitor 213 is connected in a series charging path with resistor 214 and 215 between conductors L1′ and L2 to be charged and discharged during each cycle of the AC signal provided on conductors L1′ and L2 when contacts THS are closed. This establishes a control potential at the anode of the PUT device 208. Timing capacitor 212 is connected in a unidirectional charging path with diode 216 and resistors 217 and 218, and the charging current flowing over the path provides a voltage drop across resistor 218, providing a potential which is extended the gate of the PUT device 208 over resistor 219. Thus when contacts THS close, capacitor 212 and capacitor 213 both charge, and when the anode to gate potential of the PUT device 208 exceeds +0.6 volts, the PUT device 208 is enabled permitting capacitor 213 to discharge over the PUT device and into the gate of the SCR device 37 which is connected to the cathode of the PUT device. Accordingly, the SCR device 37 is enabled, energizing the checking relay R1.

When capacitor 212 becomes fully charged, this terminates charge current flow through its associated charging network resulting in a lower gate potential for the PUT device. Accordingly, as capacitor 213 is charged in the next positive half cycle of the AC signal, the PUT device is enabled before capacitor 213 has stored sufficient charge to enable the SCR device 37, which is disabled, permitting relay R1 to drop out. However, it a flame is provided before the end of the trial for ignition period defined by gate control network 210, the further flame sensing network 222 provides a signal via diode 223 and resistor 219 to the gate of the PUT device 208 to delay its enabling, permitting SCR device 37 to continue to be enabled to keep relay R1 operated.

Referring to the flame sensing network 222, timing capacitor 225 is connected in a series charging path with a resistor 226 and the source drain circuit of the FET device 224. The FET device 224 has a gate control network including capacitor 228, resistor 229, diode 230, the secondary winding 54 of ignition transformer T2, and the spark electrodes 17, which are connected in series between conductors L1 and L2. The FET device 224 conducts bidirectionally in the absence, of a flame so that AC current is provided to capacitor 225 and it assumes a net charge of zero. When a flame is established and bridges the gap between the electrodes 17, current flows over this network charging capacitor 228, establishing a control potential at the FET gate which is connected over a resistor 231 to the junction of resistor 229 and capacitor 228. The control potential causes the FET device to be pinched off during negative half cycles, permitting capacitor 225 to charge to a net value thereby establishing a potential at point 232 which is connected to the gate of the PUT device 208 over diode 233 and resistor 219. The time constant of capacitor 225 and resistor 226 are selected such that it takes longer than one cycle of the AC signal to charge the capacitor 225 sufficiently to cause the PUT device 208 to be enabled. This prevents operation of the PUT device 208 when the FET device 224 is conducting AC current. Capacitors 235 and 236 minimize spark RFI, and resistor 238 provides a bleeder path for capacitor 228.

OPERATION

When contacts THS close, current flows from conductor L1′ through diode 216, capacitor 212 and resistors 217 and 218 to conductor L2, charging capacitor 212. The charging current provides a voltage drop across resistor 218 which, via resistor 219, is extended to the gate of the PUT device 208. Current also flows from conductor L1′ over resistor 214 and capacitor 213 to conductor L2, charging capacitor 213 and providing a potential at the anode of PUT device 208. Capacitor 213 charges at a faster rate than capacitor 212 so that the anode potential exceeds the gate potential for the PUT device 208 as the AC signal approaches its peak value during positive half cycles. At such time, capacitor 213 is charged to a value which provides sufficient discharge current for enabling the SCR device 37 when capacitor 213 discharges thereover upon enabling of the PUT device. Accordingly, the SCR device 37 conducts and relay R1 operates closing its contacts R1A to energize the pilot valve 12 and the spark generating circuit 16. Also, contacts R1B close, providing a holding path for the relay R1.

Capacitor 212 continues to charge during the trial for ignition interval, and eventually capacitor 212 becomes fully charged to cut off the flow of current over its associated charging network. Consequently, the PUT device 208 is thereafter enabled early in the positive half cycles of the AC signal and before capacitor 213 stores sufficient energy to effect enabling of the SCR device 37. Under such condition, the SCR device 37 is maintained disabled, and the relay R1 drops out opening its contacts R1A to deenergized the pilot valve 12 and the spark generating circuit 16.

Under normal operating conditions, the pilot fuel is ignited before capacitor 212 is charged, and the flame bridges the gap between spark electrodes 17 and current flows from conductor L1′ over capacitor 228, resistor 229, diode 230, winding 59, and the flame to conductor L2. The potential provided at the gate of the FET device 224 as the result of such current flow causes the FET device 224 to be pinched off during negative half cycles. Accordingly, unidirectional current flow is provided to capacitor 225 so that a charge builds up on the capacitor 225. This provides a potential at point 232 which is extended over diode 233 and resistor 219 to the gate of the PUT device 208. This delays enabling of the PUT device 208 long enough for the capacitor 213 to store sufficient energy to continue to enable the SCR device 37 to maintain relay R1 operated.

The flame sensing cicuitry also responds to the flame and operates as described above to enable relay R2 to operate to close its contcts R2C to energize the main valve and to open its contacts R2B interrupting the energizing path for the checking relay R1. Also contacts R2D open, disabling the spark generating circuit.

When the heating demand has been met, contacts THS open, deenergizing the checking relay R1 and the fuel valves, causing the flame to be extinguished. The flame sensing circuit 18 responds to the loss of flame to deenergize relay R2. Capacitor 228 of sensing circuit 206 discharges over resistor 238, and capacitor 212 of timing circuit 205 discharges over resistor 221, to prepare the system for the next heating cycle.

For a fault condition, such as a failure in the flame sensing circuitry 18 followed by a flame out on fuel interruption during a successful start up, the timing channel FET device 224 is cut off when the loss of flame is detected by its associated flame sensor. This prevents capacitor 225 from maintaining a charge, removing the control potential from the gate of the PUT device 208 which is then enabled early in each positive half cycle of the AC signal. Thus, the SCR device 37 is maintained disabled and relay R1 drops out, interrupting the energizing path for the pilot valve 12 and the main valve 14.

Having thus disclosed in detail a preferred embodiment of my invention, persons skilled in the art will be able to modify certain of the structure which has been disclosed and to substitute equivalent elements for those which have been illustrated; and it is, therefore, intended that all such modifications and substitutions be covered as they are embraced within the spirit and scope of the appended claims.

I claim:

1. In a fuel ignition system including a pilot valve operable when energized to supply fuel to a burner for ignition by sparks provided by a spark generating means to provide a pilot flame, and a main valve operable when energized to supply fuel to said burner for ignition by the pilot flame, a control arrangement comprising: activate means for generating a start signal to initiate an ignition cycle; timing circuit means including a capacitor which is charged to a given value at the start of the ignition cycle and then discharged, permitting said timing circuit means to generate an enabling signal during a trial for ignition interval defined by the discharge time of said capacitor; first switching means for controlling the operation of said pilot valve; actuating means responsive to said enabling signal to enable said first switching means to energize said pilot valve during said trial for ignition interval; said timing circuit means normally terminating said enabling signal at the end of said trial for ignition interval to disable said actuating means whereby said first switching means is disabled, and flame sensing means operable when a flame is provided at said burner during said time interval to generate a control signal for application to said timing circuit means to cause said timing circuit means to continue to provide its enabling signal after the end of said trial for ignition interval to maintain said actuating means and thus said first switching means operated after said trial for ignition interval, said flame sensing means including control means and second switching means controlled by said control means to be enabled when a flame is sensed during said trial for ignition interval to energize said main valve.

2. A system as set forth in claim 1 wherein said control means includes circuit means for providing a control output whenever a flame is provided and enabling means responsive to said control output for enabling said second switching means, said spark generating means including a spark generating circuit and further enabling means operable in the absence of said control output to enable said spark generating circuit, said further enabling means being responsive to said control output to disable said spark generating circuit.

3. A system as set forth in claim 1 wherein said second switching means is operable when enabled to disable said spark generating means, said spark generating means including further timing circuit means for permitting said spark generating means to continue to generate sparks for a predetermined time after said second switching means operates.

4. A system as set forth in claim 1 wherein said actuating means comprises a normally non-conducting controlled switching device which is enabled to conduct by said timing signal, and circuit means coupling said controlled switching device to said second switching means to permit said second switching means to be enabled in the event said controlled switching device conducts in the absence of said enabling signal and a flame.

5. A system as set forth in claim 4 wherein said first switching means is operable when enabled to inhibit said circuit means.

6. A system as set forth in claim 1 which includes further timing circuit means responsive to said start signal to enable said second switching means at the start of the ignition cycle to supply charging current to said first-mentioned timing circuit means for charging said capacitor to said given value, said further timing circuit means disabling said second switching means after a given time interval to permit said capacitor to discharge.

7. A system as set forth in claim 6 wherein said first switching means prevents energization of said main valve when said second switching means is enabled at the start of the ignition cycle.

8. A system as set forth in claim 6 wherein said second switching means, when enabled by said flame sensing means, provides said control signal to said first timing circuit means to maintain said capacitor charged.

9. A system as set forth in claim 6 wherein said further timing circuit means comprises a further capacitor and circuit means for permitting said further capacitor to charge in response to said start signal, said further timing circuit means disabling said second switching means when said further capacitor is charged to a given value.

10. In a fuel ignition system including a pilot valve for supplying fuel to a burner for ignition to provide a pilot flame, and a main valve for supplying fuel to said burner for ignition by the pilot flame, a control arrangement comprising: ignition timing means operable from an initial state to provide a timing signal for a predetermined interval of time and to terminate said timing signal at the end of said time interval; first switching means enabled by said timing signal to energize said pilot valve; second switching means; flame sensing means operable when a flame is provided during said time interval to enable said second switching means to prevent said ignition timing means from terminating its timing signal and to energize said main valve; and cycle timing means effective at the start of an operating cycle to enable said second switching means to set said ignition timing means to its initial state and to then disable said second switching means; said first switching means preventing energization of said main valve while said second switching means is enabled by said cycle timing means.

11. A system as set forth in claim 10 wherein said ignition timing means comprises a timing network including a capacitor which is charged to a given value at the start of the ignition cycle and then discharged to provide said timing signal, said second switching means being operable when enabled to provide a charging path for said capacitor.

12. A system as set forth in claim 11 wherein said ignition timing means includes reset means for providing a discharge path for said capacitor whenever said first switching means is disabled while said charging path is interrupted, said first switching means being operable when enabled to inhibit said reset means.

13. A system as set forth in claim 11 wherein said cycle timing means comprises a further capacitor and circuit means for permitting said further capacitor to charge in response to a start signal provided by an activate means, said cycle timing means disabling said second switching means when said further capacitor is charged to a given value.

14. A system as set forth in claim 13 wherein said cycle timing means further comprises reset means for discharging said further capacitor upon termination of said start signal.

15. A system as set forth in claim 11 wherein said second switching means comprises a relay having first normally closed contacts connected in an energizing path for said first switching means and second normally open contacts connected in said charging path for said capacitor.

16. Apparatus for controlling the operation of a pilot valve actuated by a pilot valve solenoid and a main valve actuated by a main valve solenoid to supply fuel to a pilot outlet and a main burner for ignition, said apparatus comprising: first switching means; cycle timer circuit means responsive to a call for heat signal for enabling said first switching means for a predetermined time period and for disabling said first switching means at the end of said predetermined time period; ignition timer circuit means responsive to the operation of said first switching means for generating a timing signal representative of a desired trial-for-ignition period; second switching means; and circuit means responsive to said timing signal and to the disabling of said first switching means for enabling said second switching means to energize said pilot valve solenoid to cause fuel to flow to said pilot outlet.

17. The apparatus of claim 16 wherein said first switching means comprises a relay having normally closed contacts connected in an energizing path for said second switching means to prevent said second switching means from being enabled by said circuit means whenever said contacts are open at the time of occurrence of said call for heat signal.

18. The apparatus of claim 16 further comprising flame sensing means operable when a flame is provided during said trial-for-ignition period to reenable said first switching means to energize said main valve solenoid to cause fuel to flow to said main burner and to establish a holding current in said ignition timer circuit means to maintain said second switching means enabled after said trial-for-ignition period.

19. The apparatus of claim 18 wherein said ignition timer circuit means comprises a capacitor which is charged when said first switching means is enabled following the occurrence of said call for heat signal and which discharges to provide said timing signal when said first switching means is thereafter disabled, and said capacitor being prevented from discharging when said first switching means is reenabled by said flame sensing means.

20. The apparatus of claim 19 which further comprises reset means for rapidly discharging said capacitor upon termination of said call for heat signal, said second switching means inhibiting said reset means whenever said second switching means is enabled by said circuit means.

21. A method of controlling the operation of a pilot valve and a main valve in a gaseous fuel system in which the valves are operated respectively by a pilot valve solenoid and a main valve solenoid and in response to a call for heat comprising: energizing a first switching means by means of a cycling timer for a predetermined time and deenergizing said first switching means after said predetermined time; initializing an ignition timer when said first switching means is energized and causing said ignition timer to time out at the end of a trial-for-ignition period initiated when said first switching means is deenergized; energizing a second switching means when said first switching means is deenergized; actuating said pilot valve solenoid when said second switching means is energized; and re-energizing said first switching means in response to detection of a flame during said trial-for-ignition period.

22. The method of claim 21 further comprising establishing a holding current for said ignition timer when said first switching means is re-energized to maintain said ignition timer in an operated state, thereby continuing to energize said second switching means.

23. In a fuel ignition system including fuel valves having a pilot valve for supplying fuel to a pilot outlet for ignition to provide a pilot flame, and a main valve for supplying fuel to a main burner for ignition by the pilot flame, a method of controlling the operation of the fuel valves comprising: enabling a first switching means by means of a cycle timer for a predetermined time at the start of an operating cycle and disabling said first switching means at the end of said predetermined time; initializing an ignition timer when said first switching means is enabled; enabling a second switching means during a trial-for-ignition period by means of said ignition timer; actuating said pilot valve when said second switching means is enabled; sensing for a pilot flame by means of a flame sensing means; actuating said main valve and causing said second switching means to be maintained enabled after said trial-for-ignition period when a flame is sensed during said trial-for-ignition period; and causing said second switching means to deactuate said pilot valve at the end of said trial-for-ignition period and preventing actuation of said main valve whenever a flame fails to be sensed during said trial-for-ignition period.

* * * * *

UNITED STATES PATENT AND TRADEMARK OFFICE

CERTIFICATE OF CORRECTION

PATENT NO. : 4,230,444

DATED : October 28, 1980

INVENTOR(S) : Russell B. Matthews

It is certified that error appears in the above—identified patent and that said Letters Patent is hereby corrected as shown below:

Column 22, line 28, "timing" should be -- enabling --.

Signed and Sealed this

Tenth Day of March 1981

[SEAL]

*Attest:*

RENE D. TEGTMEYER

*Attesting Officer*

*Acting Commissioner of Patents and Trademarks*